US010030470B2

(12) United States Patent
Ingold

(10) Patent No.: US 10,030,470 B2
(45) **Date of Patent: *Jul. 24, 2018**

(54) CEMENTING TOOL

(71) Applicant: Charles Ingold, Miami, FL (US)

(72) Inventor: Charles Ingold, Miami, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/162,567

(22) Filed: May 23, 2016

(65) Prior Publication Data

US 2016/0312571 A1 Oct. 27, 2016

Related U.S. Application Data

(63) Continuation of application No. 14/209,928, filed on Mar. 13, 2014, now Pat. No. 9,464,503.

(60) Provisional application No. 61/782,058, filed on Mar. 14, 2013.

(51) Int. Cl.
*E21B 33/13* (2006.01)
*E21B 17/02* (2006.01)

(52) U.S. Cl.
CPC ..... *E21B 33/13* (2013.01); *E21B 17/02* (2013.01)

(58) Field of Classification Search
CPC ..... E21B 33/16; E21B 33/14; E21B 33/05; E21B 33/12; E21B 33/13; E21B 33/1208; E21B 33/10
See application file for complete search history.

(56) References Cited

U.S. PATENT DOCUMENTS 4,042,014 A * 8/1977 Scott ..... E21B 33/05 166/154
4,813,497 A * 3/1989 Wenzel ..... E21B 7/067 166/237
4,966,236 A * 10/1990 Braddick ..... E21B 43/10 166/153
5,137,087 A * 8/1992 Szarka ..... E21B 17/04 166/117.7
5,244,050 A * 9/1993 Estes ..... E21B 10/18 175/393
5,484,029 A * 1/1996 Eddison ..... E21B 7/067 175/50
6,321,857 B1 * 11/2001 Eddison ..... E21B 17/1014 175/325.3
9,464,503 B2 * 10/2016 Ingold ..... E21B 33/13
2003/0024741 A1 * 2/2003 Wentworth ..... E21B 7/046 175/73

(Continued)

FOREIGN PATENT DOCUMENTS

CA 2303734 A1 * 10/2000 ..... E21B 33/14

*Primary Examiner* — Daniel P Stephenson
(74) *Attorney, Agent, or Firm* — The Kubiak Law Firm, PLLC

(57) ABSTRACT

A secondary cementing apparatus includes a drill string, a coupling coupled to a distal end of the drill string, and a tool coupled to a distal end of the coupling, the tool having a distal portion offset from a central axis of the drill string, and the coupling configured to allow selective rotation of the tool with respect to the drill string. A method for plugging a hole includes rotating a drill string about a central axis of the drill string, wherein a distal end of the drill string is coupled to a tool, the tool having an offset distal portion from a central axis of the drill string; and flowing a fluid down the drill string and out of the offset distal portion of the tool as the drill string is rotated.

3 Claims, 8 Drawing Sheets

(56) References Cited

U.S. PATENT DOCUMENTS

| | | | | |
|---|---|---|---|---|
| 2005/0274548 | A1* | 12/2005 | Albert | E21B 3/025 175/61 |
| 2008/0067810 | A1* | 3/2008 | Peer | E21B 33/05 285/272 |
| 2012/0138297 | A1* | 6/2012 | Johnson | E21B 33/16 166/285 |
| 2012/0247767 | A1* | 10/2012 | Themig | E21B 21/103 166/289 |
| 2014/0251695 | A1* | 9/2014 | Marchand | E21B 4/02 175/74 |
| 2014/0262266 | A1* | 9/2014 | Ingold | E21B 17/02 166/285 |
| 2016/0017689 | A1* | 1/2016 | Steele | E21B 34/12 166/250.01 |

* cited by examiner

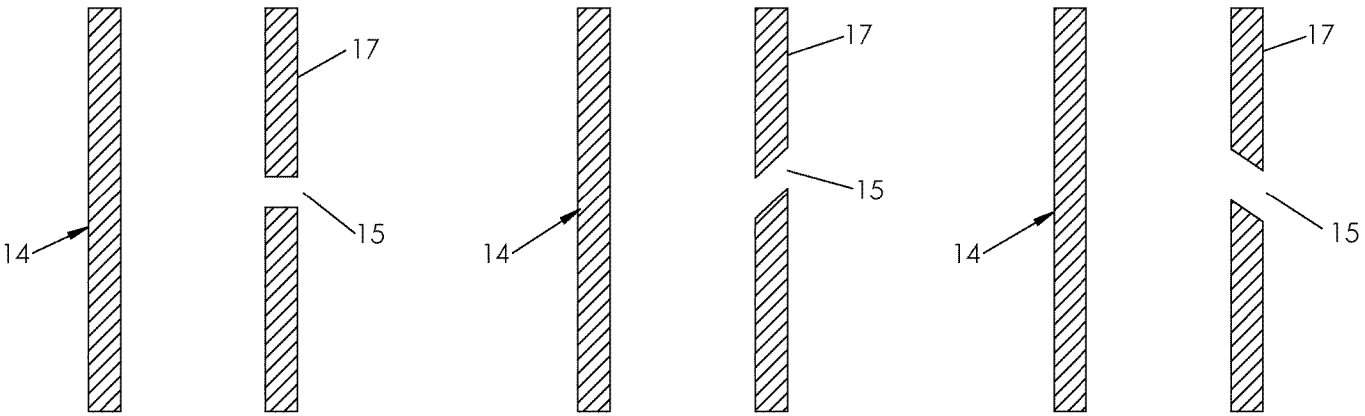
FIGURE 6A
FIGURE 6B
FIGURE 6C
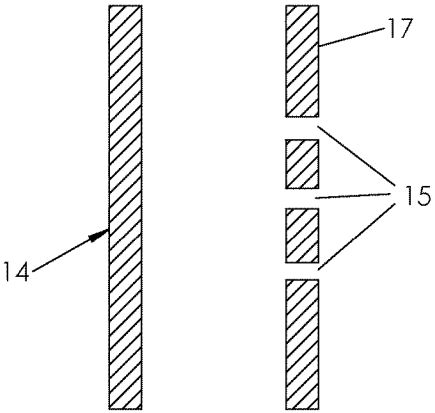
FIGURE 6D
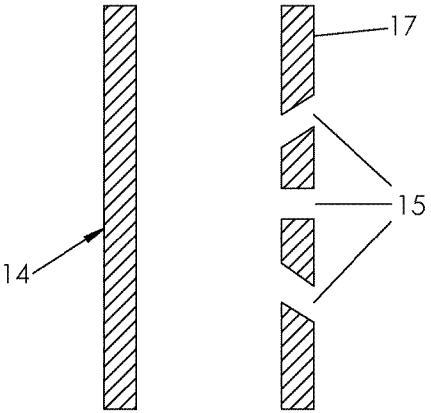
FIGURE 6E

CEMENTING TOOL

CROSS-REFERENCE TO RELATED APPLICATIONS

This application claims priority to U.S. Provisional Patent Application No. 61/782,058 that was filed on Mar. 14, 2013, and to U.S. patent application Ser. No. 14/209,928 that was filed on Mar. 13, 2014.

BACKGROUND

After a reservoir or well has been drained or if it is determined that a reservoir does not possess sufficient hydrocarbon reserves, steps are taken to ensure proper abandonment of the reservoir. These steps typically include plugging the annulus and wellbore with cement to isolate the reservoir.

When plugging a hole for abandonment, it is important that the cement plug is robust and completely fills the wellbore and annulus to prevent channeling and ensure longevity of the plug. Channeling occurs if cement does not completely fill the wellbore and annulus, creating pockets that may allow migration of gas. Extreme cases of channeling may result in an oil spill or contamination of nearby aquifers. In order to avoid these extreme cases, if a hole has not been properly isolated remedial cementing may be required, which is both time consuming and expensive.

Channeling complications are common in horizontal holes, deviated holes, and large holes due to inadequate borehole coverage. For example, the drill string may not be centered making it difficult for the cementing tool to completely fill the upper region or the high side of the hole. As a result, channeling on the high side is a common occurrence. In large holes the diameter of drill string may be only a fraction of the diameter of the hole. Due to this size difference the tool may not be able to direct cement to the outer edges of the borehole to create a robust plug. In addition, the hole may be irregularly shaped, such as an egg shape or an oval shape, making sufficient borehole coverage difficult. Further, even if initial channeling is minimized, pockets of contaminated cement and mud may prevent isolation of a reservoir. Furthermore, free water in the cement may migrate to the high side compounding channeling problems.

SUMMARY

In one aspect, embodiments disclosed herein relate to a secondary cementing apparatus including a drill string, a coupling coupled to a distal end of the drill string, and a tool coupled to a distal end of the coupling, the tool having a distal portion offset from a central axis of the drill string, and the coupling configured to allow selective rotation of the tool with respect to the drill string.

In another aspect, embodiments disclosed herein relate to a secondary cementing apparatus including a drill string, a tool coupled to the drill string, the tool having a lower portion offset from a longitudinal axis of the drill string, and a collar disposed between a distal end of the drill string and a proximal end of a tool configured to restrict rotational movement of the tool with respect to the drill string.

In yet another aspect, embodiments disclosed herein relate to a method for plugging a hole including rotating a drill string about a central axis of the drill string, where a distal end of the drill string is coupled to a tool, the tool having an offset distal portion from the central axis of the drill string, and flowing a fluid down the drill string and out of the offset distal portion of the tool as the drill string is rotated.

This summary is provided to introduce a selection of concepts that are further described below in the detailed description. This summary is not intended to identify key or essential features of the claimed subject matter, nor is it intended to be used as an aid in limiting the scope of the claimed subject matter.

BRIEF DESCRIPTION OF DRAWINGS

FIGS. 6A-6E show cross sectional views of port profiles in accordance with embodiments disclosed herein.

DETAILED DESCRIPTION

Generally, embodiments disclosed herein relate to methods and devices for secondary cementing operations. More specifically, the present disclosure relates to a method and device for plugging horizontal, large, and deviated holes.

Embodiments disclosed herein relate to a cementing tool that includes an offset portion. In one aspect, embodiments disclosed herein relate to a cementing tool that is coupled to the drill string such that the cementing tool rotates continuously with the drill string. In another aspect, embodiments disclosed herein relate to a cementing tool that includes a mechanism for allowing rotation of the offset portion relative to the drill string.

Figure 1:
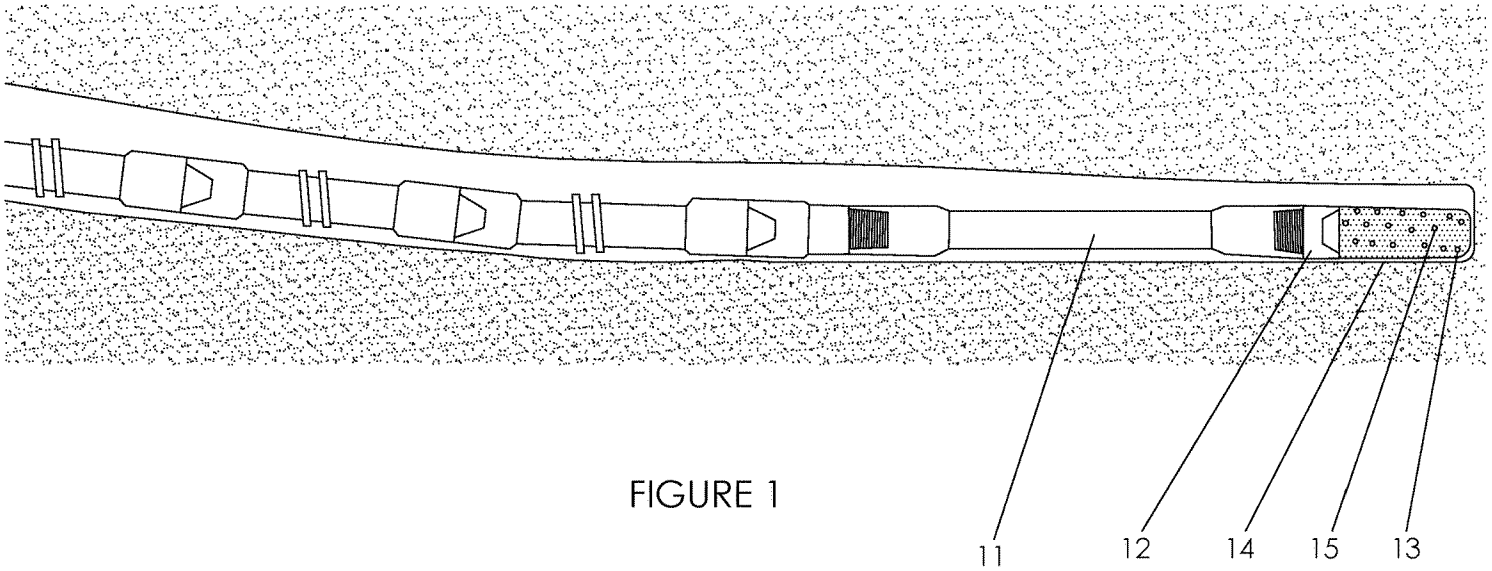
FIG. 1 is a perspective view of a cementing tool for horizontal holes.
Figure 2:
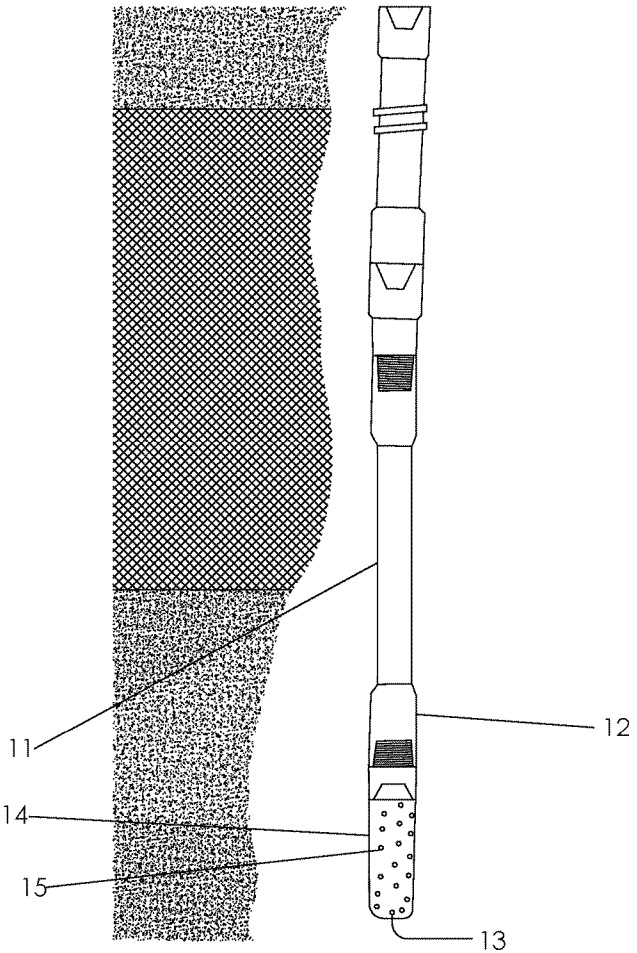
FIG. 2 is a perspective view of a cementing tool.

FIG. 1 shows a cementing tool 14 disposed in a horizontal hole. FIGS. 1 and 2 illustrate a substantially straight secondary cementing assembly coupled via coupling 12 to a distal end of a drill string 11 disposed in horizontal holes and large holes, respectively. As used herein, the terms distal and proximal are used to mean closer to the bottom of a hole and closer to the surface of a hole, respectively. The secondary cementing assembly operates by positioning the drill string downhole, rotating the drill string and as a result rotating the cementing tool 14. While the secondary cementing assembly rotates, fluid such as cementing fluid is pumped downhole and out the cementing tool 14 into the borehole. The fluid may flow down through a central bore of the cementing tool 14 and out a bottom opening 13 at the distal end of the cementing tool 14 axially aligned with the central bore. A diameter of the bottom opening 13 may be approximately equal to or less than a diameter of the central bore of the cementing tool 14. In some embodiments, the distal end of the cementing tool 14 may be sealed and a plurality of ports 15 disposed on a side of the cementing tool 14. In other words, the ports 15 extend radially from an inner surface to an outer surface of the cementing tool 14. In yet other embodiments, the cementing tool 14 may include a bottom opening 13 and one or more side ports 15.

Figure 3:
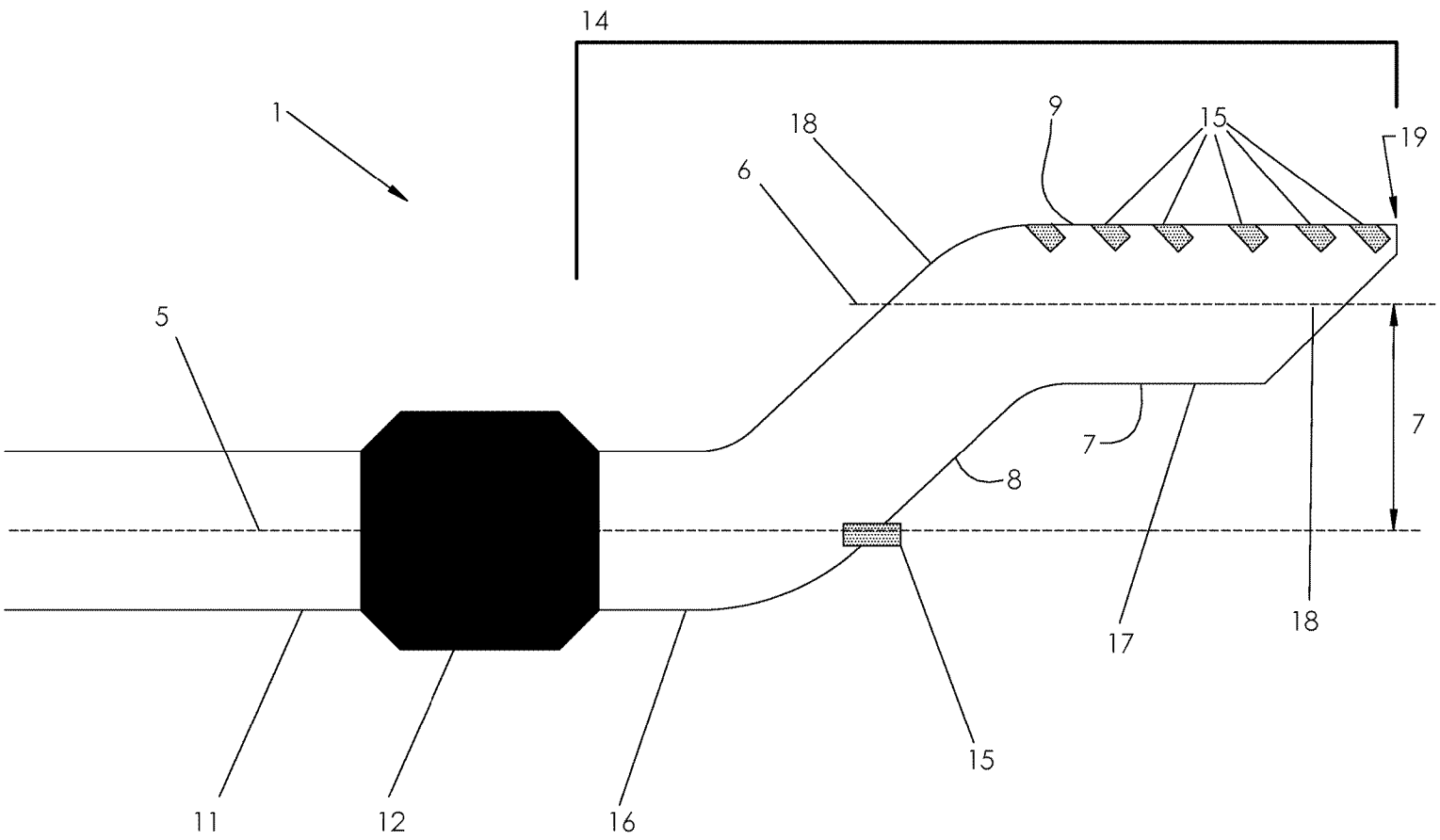
FIG. 3 is an enlarged view of a cementing tool coupled to the lower end of a drill string in accordance with embodiments disclosed herein.

Referring to FIG. 3, an enlarged view of a secondary cementing assembly 1 is shown in accordance with one or more embodiments of the disclosure. A secondary cementing assembly 1 may include a cementing tool 14 coupled to a distal end of a drill string 11. As used herein, the term "tool" is not meant to limit the scope of this disclosure to just cylindrical bodies, any suitable tool shape may be used without departing from the scope of the application. The cementing tool 14 may have a first portion 16 axially aligned with the drill string 11 and a second portion 17 axially offset from the drill string. As used herein, the second portion 17 may also be referred to as an offset portion. A third portion 18 extending radially outward from a central axis 5 of the drill string 11 is located between and connects the first and second portions such that the first portion 16 is located at a proximal end of the cementing tool 14 and the second portion 17 is located at a distal end of the cementing tool 14.

In one example, the cementing tool 14 may include a bent sub or tubular. One of ordinary skill in the art will appreciate that the first, second, and third portions 16, 17, 18 may be integrally formed or may be separate components coupled together by any means known in the art, such as threaded engagement, press fit, welding, mechanical fastener, etc. In some embodiments, the third portion 18 may include a swivel mechanism 25 such that the second portion may swivel with respect to the first portion 16. The swivel mechanism 25 may be located anywhere along the length of the third portion 18. The first portion 16 may be coupled to the drill string and rotate therewith. This embodiment will be discussed in greater detail below.

The first portion 16 may be aligned with the drill string 11 such that it is centered about the central axis 5 of the drill string 11. The central axis 5 may be described as running along the length of the drill string 11 through the center of the drill string 11. This allows the first portion 16 to be aligned with a distal end of the drill string 11. The first portion 16 may be coupled to the drill string with a coupling 12. In some embodiments, the coupling 12, for example a collar, may be configured to allow the cementing tool 14 to rotate continuously with the drill string 11. In other words, the coupling 12 may allow for the cementing tool 14 to be rotationally fixed to the drill string 11, i.e., the cementing tool 14 rotates with the drill string 11, not with respect to the drill string 11, during operation of the secondary cementing assembly 1. For example, the coupling 12 may include threads, screws, rivets, welds, or any coupling known in the art without departing from the scope of this disclosure. In other embodiments, the coupling 12 may be configured to allow rotation of the cementing tool 14 relative to the drill string 11. This latter embodiment will be discussed in more detail below.

Referring still to FIG. 3, the second portion 17 may be offset from the first portion 16 and central axis 5. The offset of the cementing tool 14 may be quantified by an offset distance 7. The offset distance 7 may be measured as the distance from the central axis 5 to an offset axis 6 of the second portion 17. The offset axis 6 may be described as a central axis of the second portion 17. The offset distance 7 may vary based on the angle of inclination of the borehole, the size of the borehole, the size of the drill string, and/or the size of the cementing tool. For example, the offset distance 7 may be about 5 in. with the use of a 5 in. drill pipe. Such an offset may provide an equivalent reach of about 10.75 in., which may be suitable for use in holes ranging, for example, from about 12.25-16 in. in diameter. In another embodiment, the offset distance 7 may be about 7 in. Such an offset may provide a reach of about 12.75 in., suitable for use in holes ranging, for example, from about 17.5 in. to 20 in. in diameter. In some other embodiments, the offset distance 7 may be about 9 in. Such an offset may provide an equivalent reach of about 14.75 in., which may be suitable for use in holes ranging, for example, from about 22-26 in. in diameter. The diameter of the cementing tool 14 may vary depending on the size of the borehole; the diameter may be, for example, between about 2 in. to about 5 in. The above offset distances and corresponding borehole sizes are merely examples. One of ordinary skill in the art will understand that other offset distances 7 and cementing tool 14 diameters may be used in various sized boreholes without departing from the scope of the present disclosure.

The offset portion 17 may include at least one port 15 configured to direct fluid flow from the cementing tool 14 to the borehole or annulus. At least one port 15 may be disposed on an outwardly facing surface 9 of the offset portion 17. As used herein, the outwardly facing surface 9 of the offset portion 17 refers to a surface of the offset portion 17 that faces radially away from the central axis 5 of the drill string 11, as shown in FIG. 3. Ports disposed on the outwardly facing surface 9 of the offset portion 17 allows fluid flow from the cementing tool 14 to be directed to the annulus formed between the wellbore (not shown) and the cementing tool 14. In some embodiments, one or more ports 15 may also be included on the third portion 18 of the cementing tool 14. Various configurations of one or more ports 15 in accordance with embodiments disclosed herein are described below with reference to FIGS. 3, 5A-5E, and 6A-6C.

As shown in FIG. 3, a plurality of ports 15 may be arranged along a length of the outwardly facing surface 9 of the offset portion 17. The plurality of ports 15 may be disposed in columns along the length of the offset portion 17. Each column may have at least one port. The number of ports 15 in a column may depend on, for example, the length of the second portion, the viscosity of the fluid exiting the port, and the size of the port. The ports 15 in each column may be substantially aligned in a vertical direction. The ports 15 disposed in a column may be evenly spaced such that the vertical distance between each port is substantially the same or the ports 15 may be irregularly spaced. Further, in embodiments with multiple columns of ports 15, the columns may start at substantially the same vertical height along the second portion. However, columns may be arranged such that the topmost port of a first column may not be at the same vertical height as the topmost port of a second column. In yet other embodiments, the ports 15 may be randomly arranged on the offset portion 17, such that the ports are not disposed in specific columns or rows.

Figure 5A:
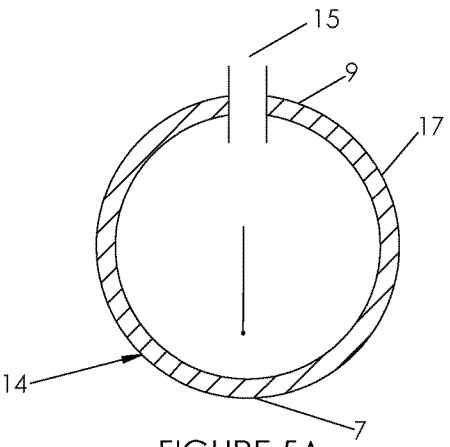
FIGS. 5A-5E show cross sectional views of locations of ports for a secondary cementing assembly in accordance with embodiments disclosed herein.

FIGS. 5A-5E are cross-sectional views of the offset portion 17 of cementing tool 14 that illustrate possible locations for the ports 15 along the outer circumference of offset portion 17. The arrow in these figures originating at the center of the offset portion 17 indicates a direction towards the central axis 5 (FIG. 3). Referring to FIG. 5A, in some embodiments one or more ports 15 may be located substantially opposite the central axis 5 on the outwardly facing surface 9 of the second portion 17. By disposing ports 15 on the outwardly facing surface 9 of the second portion 17, the cementing tool 14 may provide a larger circumference of fluid coverage than if the ports 15 were located on an inwardly facing surface 7 of the offset portion 17 (i.e., a side or surface of the cementing tool 14 facing the central axis 5).

Figure 5B:
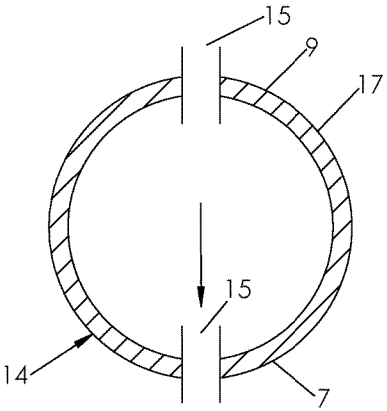
Figure 5C:
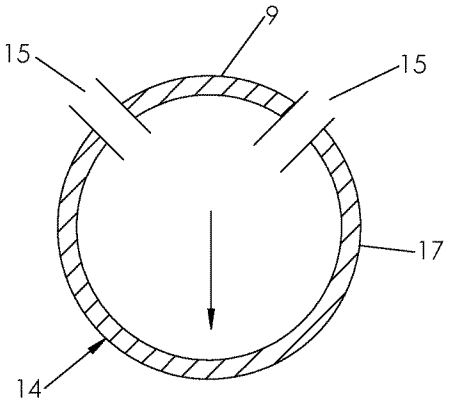
Figure 5D:
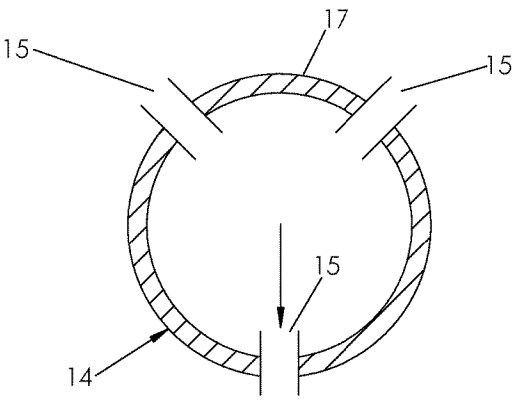
Figure 5E:
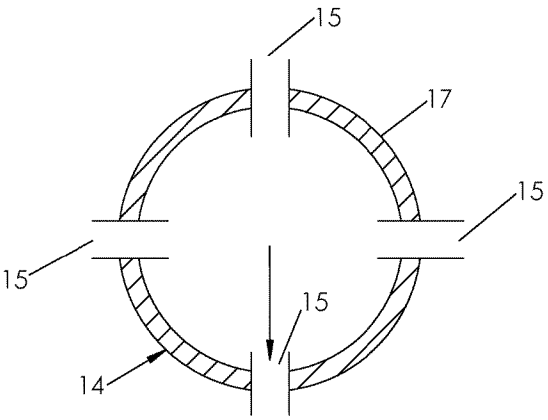

Referring to FIG. 5B, some embodiments may include two or more ports 15 located about 180 degrees apart. For example, one port or a column of ports may be disposed on the outwardly facing surface 9 of the offset portion 17 and a port or column of ports may be disposed on the inwardly facing surface 7 of the offset portion 17, approximately 180 degrees apart. By disposing one or more ports 15 on the inwardly facing surface 7 of the offset portion 17, the cementing tool 14 may provide sufficient fluid coverage of the center of the borehole. Referring to FIG. 5C, two ports 15 or two columns of ports 15 may be disposed in the outwardly facing surface 9 azimuthally spaced apart. The angle of separation of the ports 15 may vary without departing from the scope of embodiments disclosed herein. FIGS. 5D and 5E show additional locations of ports 15 azimuthally spaced around the offset portion 17. One of ordinary skill in the art will understand that the offset portion 17 may include any number of ports 15 arranged in various configurations (e.g., columns, rows, staggered) about the outer circumference of the offset portion 17 without departing from the scope of the present disclosure. Further, these ports 15 may be arranged at regularly spaced angles or irregularly spaced angles about the circumference of the second portion 17.

Referring back to FIG. 3, in some embodiments a port 15 may be configured to direct fluid flow out of the cementing tool 14 in a direction substantially aligned with the central axis 5. That is to say fluid is directed substantially downward. For example, one or more ports 15 may be disposed on an axially downward facing surface 8 of the third portion 18. Ports 15 disposed on the downward facing surface 8 of the third portion 18 may help direct fluid substantially downward to provide fluid coverage of the center of the borehole.

In some embodiments, a distal end 19 of second portion 17 may be capped to prevent fluid from exiting the bottom, thereby forcing fluid to exit through the ports 15. In some other embodiments, the distal end of second portion 17 may be left open to allow for further downhole coverage in addition to the ports 15.

In addition to the location and arrangement of ports 15 on cementing tool 14, the configuration of each port may be selected to further enhance fluid flow exiting the cementing tool 14 and coverage of fluid within the borehole. For example, the ports 15 may be angled axially upward, downward, or perpendicular to the central axis 5. FIGS. 6A-6E are cross-sectional views of the offset portion 17 of the cementing tool 14 that illustrate different profiles of the ports 15. FIG. 6A shows a port with a profile perpendicular to the central axis 5 (FIG. 3) and configured to direct fluid radially outward and perpendicular to the offset portion 17. FIG. 6B shows an upwardly angled port to direct fluid upward. FIG. 6C shows a downwardly angled port to direct fluid downward. The angle of the ports 15 may vary, for example, the angle of the ports may be about ±30, ±45, or ±60 degrees as measured from the central axis 5. A tool with a plurality of ports 15 may include ports with one type of port profile, as shown in FIG. 6D, or may include more than one type of port profile, as shown in FIG. 6E. Thus, any combination of angled ports 15 may be used without departing from the scope of embodiments disclosed herein. Further, while FIGS. 6A-6E show only the ports 15 in offset portion 17, one of ordinary skill in the art will appreciate that the port 15 in the third portion 18 (FIG. 3) may be similarly angled to enhance fluid flow within the wellbore. For example, instead of the port 15 being axially aligned with central axis 5, the port may be angled toward or away from the offset portion 17 or in any other direction. The port 15 of the third portion 18 may be angled by any desired angle, for example, 5, 10, 20, and 30 degrees.

Although only a few examples have been provided, the arrangement of ports 15 and the use of different port profiles (including angles) on the offset portion 17 may vary without departing from the scope of the embodiments disclosed herein.

In another embodiment, the cementing tool 14 may be coupled to the drill string 11 with a coupling 12 that allows rotation of the cementing tool 14 relative to the drill string 11. There are many ways to produce a relative rotation of the cementing tool 14. In one embodiment, such a coupling 12 may include bearings, bushings, or a clutch. A coupling that allows rotation of the cementing tool 14 relative to the drill string 11 may provide a greater circumference of downhole coverage of fluid flow than a substantially straight cementing tool. For example, a clutch coupling may be used in applications where the drill string is not centered downhole, e.g., horizontal or deviated wells. The clutch may be a spring loaded clutch, for example, a spring loaded ratchet swivel, an electromagnetic clutch, a hydraulic clutch or any other clutch known in the art. Accordingly, the type of clutch and engagement mechanism is not a limitation of the present disclosure.

Figure 7A:
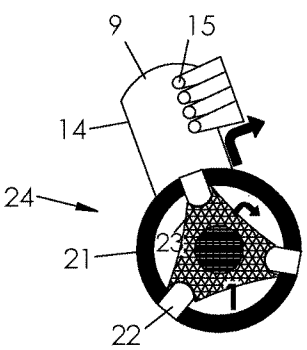
FIGS. 7A-7F show a sequence of cross-sectional views of a secondary cementing assembly plugging a hole in accordance with embodiments disclosed herein.
Figure 7B:
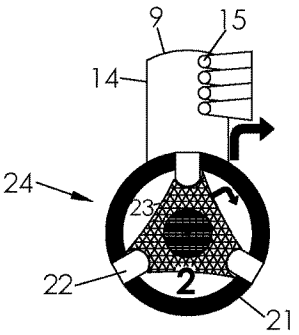

In embodiments with a spring loaded clutch, the spring loaded clutch may include a spring loaded clutch mechanism. FIGS. 7A-7F show a spring loaded clutch mechanism with a spring loaded ratchet swivel 24. The spring loaded ratchet swivel 24 may include a latch 21 with at least one spring loaded cam 22 seated in the inner circumference of the latch 21. In some embodiments, a plurality of cams 22 may be seated in the inner circumference of the latch 21. As shown in FIGS. 7A-7F, the cams 22 may be spaced apart at regular intervals; however the cams 22 may also be spaced apart at irregular intervals without departing from the scope of this disclosure. A ratchet 23 may be coupled to the distal end of the drill string, such that the ratchet 23 rotates continuously with the drill string. The cams 22 of the latch 21 may engage with the ratchet 23, such that when the latch 21 and ratchet 23 are engaged, the cementing tool 14 rotates continuously with the drill string, as shown in FIGS. 7A and 7B.

Figure 7C:
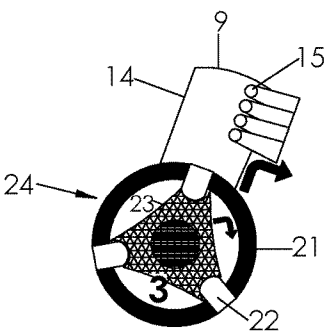
Figure 7D:
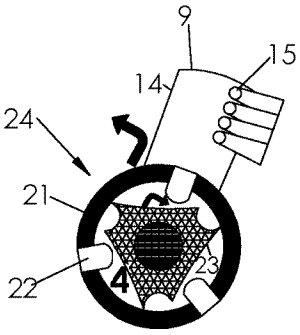
Figure 7E:
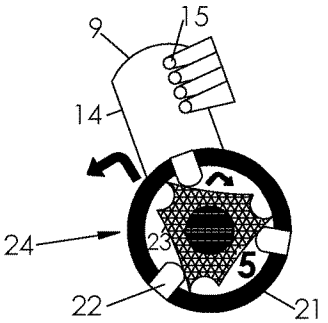
Figure 7F:
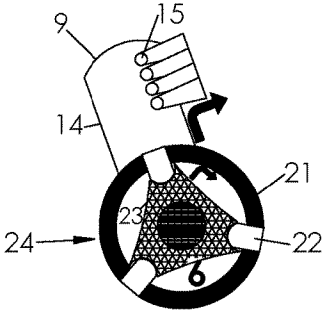

The cementing tool 14 may rotate with the drill string until a preselected degree, as shown in FIG. 7C. In some embodiments, the cementing tool 14 may rotate with the drill string 11 until the outwardly facing surface 9 of the cementing tool 14 comes into contact with a side of the borehole. Once a preselected degree is reached, a torque may be exerted on the ratchet 23 causing the cams 22 to release the ratchet 23, thereby disengaging the ratchet 23 from the latch 21. The torque may be, for example, a resistance torque. Resistance torque may be caused when the ratchet prevents the cementing tool 14 from rotating with the drill string 11. However, the torque exerted on the ratchet may be applied by sources other than resistance torque from the drill string without departing from the scope of this application. Once the ratchet 23 and the latch 21 are disengaged (FIG. 7D), biasing springs in the ratchet 23 may cause the cementing tool 14 to rotate in the opposite direction of the drill string (FIGS. 7D and 7E). The cementing tool 14 will continue to rotate in the opposite direction of the drill string 11, until cams 22 of the latch 21 engage the ratchet 23 (FIG. 7F).

In embodiments with a hydraulic clutch, the hydraulic clutch may include a clutch plate mechanism. The hydraulic clutch plate mechanism works much the same way as a spring loaded clutch, but uses fluid pressure instead of spring force from torque for engagement. In embodiments with the electromagnetic clutch, the electromagnetic clutch may include an electromagnet, a rotor, a hub, and an armature. The electromagnetic clutch may be engaged by flowing a current through the electromagnet, thereby creating a magnetic field to induce rotation of the armature and move the armature into contact with the rotor. The hub, which may be operatively coupled to the armature, may be accelerated to match the speed of the rotor, thus engaging the clutch. A clutch coupling as discussed herein may allow the cementing tool 14 to rotate with the drill string 11 a predetermined amount, e.g., 45 degrees, 90 degrees, etc., before the clutch is disengaged, thereby allowing the cementing tool 14 to rotate with respect to the drill string 11. This may allow the cementing tool 14 to rotate only within a predetermined azimuthal range, while the drill string 11 is allowed to continually rotate a full 360 degrees.

Referring again to FIG. 3, a secondary cementing assembly 1 in accordance with the description above may be disposed downhole for operation. The hole may be a horizontal hole, a deviated hole, or a large hole. As used herein, a hole may be considered large if said hole has a diameter greater than approximately 16 in. A hole may also be considered large if the ratio between the diameter of the borehole and the outer diameter of the drill string is greater than 3. The position of the drill string 11 may be centered, off-centered, or resting along a wall of the borehole. However, if the ratio between the diameter of the borehole and the outer diameter of the drill string exceeds 3, it may be desirable to centralize the drill string. Once the secondary cementing assembly 1 has been disposed downhole, the drill string 11 may be rotated about the central axis 5. As the drill string 11 is rotated, a fluid may be sent downhole through the drill string 11 and flow out of the ports 15 of the cementing tool 14.

Figure 4A:
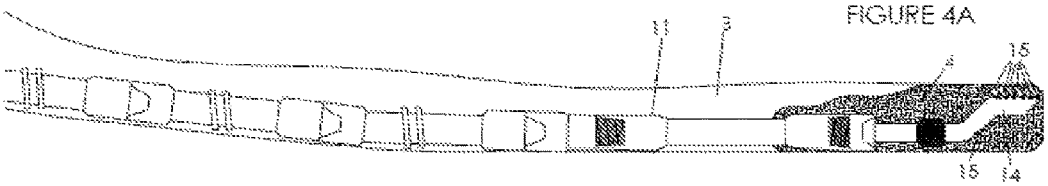
FIGS. 4A-4C show perspective views of a sequence of a secondary cementing assembly plugging a hole in accordance with embodiments disclosed herein.
Figure 4B:
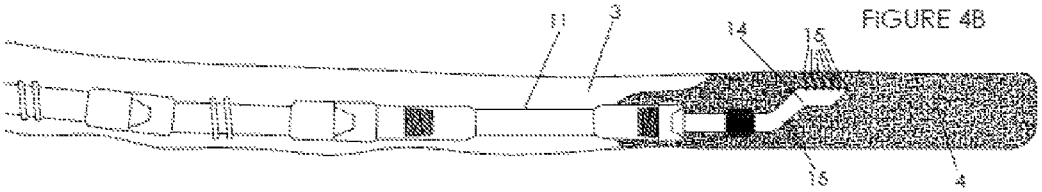
Figure 4C:
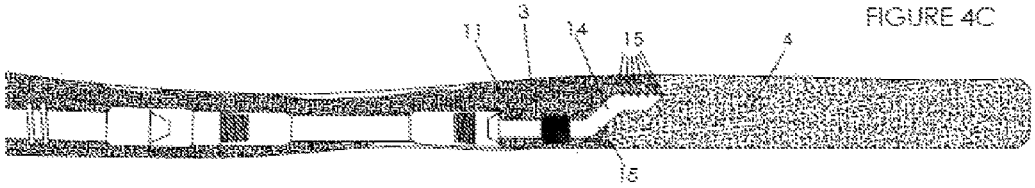

As discussed above, some embodiments may include a coupling 12, for example a collar, configured to allow the cementing tool to rotate with the drill string 11. In embodiments with a collar as a coupling, the cementing tool will rotate continuously with the drill string 11 while fluid flows through ports 15. One or more ports may be located on the outwardly facing surface 9 of offset portion 17. By locating one or more ports 15 on the outwardly facing surface 9, the offset portion 17 may provide a greater circumference of coverage than a substantially straight cementing tool. While ports located on the outwardly facing surface 9 may provide a greater circumference of coverage, ports located on the inwardly facing surface 7 of the offset portion 17 or on the bottom of the third portion 18 may provide fluid coverage of the central portion of the borehole. Referring to FIGS. 4A-4C, a sequence of perspective views of a secondary cementing operation is shown. As shown, cement 4 flows out through ports 15 of the cementing tool 14. During the secondary cementing operation, once cement 4 fills a borehole 3 at a particular depth, drill string 11 may be raised while continuing to rotate the drill string 11 and therefore the cementing tool 14, to provide coverage at a new depth. The process of rotating the drill string and flowing fluid out of the cementing tool may be continued until a column of cement forms, creating a plug.

Figure 8B:
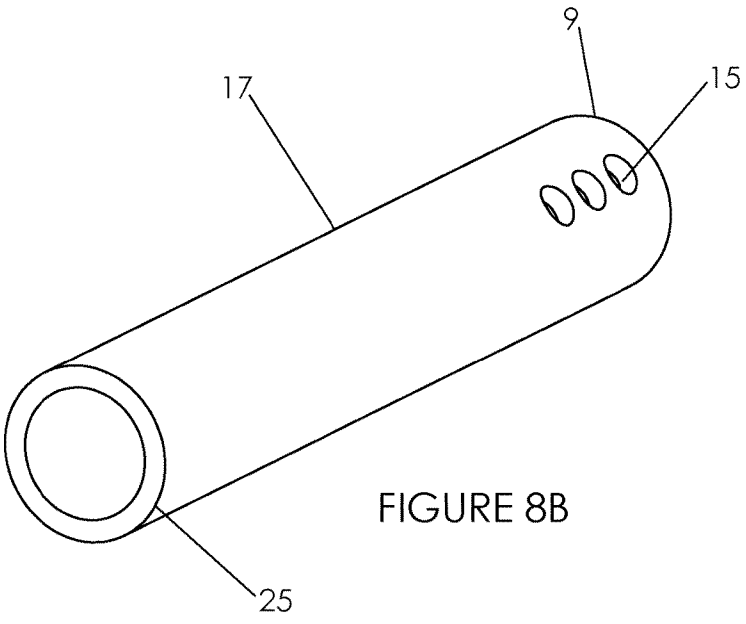
FIGS. 8A-8B show cross-sectional views of a secondary cementing assembly plugging a hole in accordance with embodiments disclosed herein.
Figure 8A:
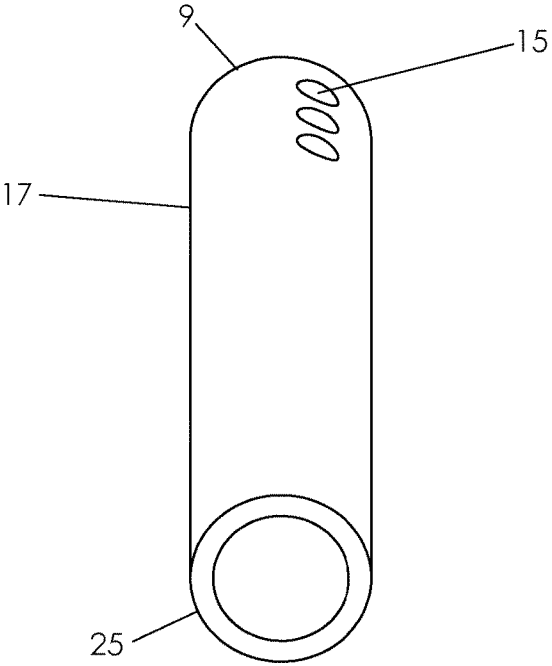

As discussed above, some embodiments may include a third portion 18 comprising a swivel mechanism 25. This swivel mechanism 25 may allow the second portion 17 to swivel with respect to the first portion 16; the first portion 16 being coupled to the drill string 11 and rotating therewith. In embodiments with a third portion 18 having a swivel mechanism 25, the secondary cementing assembly may be disposed downhole such that the second portion 17 is at an initial position in the high side of the hole as shown in FIG. 8A. The drill string 11 may be rotated such that the first portion 16 rotates with the drill string 11 as cement is flowing down the drill string 11 and out of the ports 15. The ports may be located, for example, on the outwardly facing side 9 of second portion 17 and the downward facing surface 8 to provide adequate fluid coverage. Due to the swivel mechanism 25 of the third portion 18, the second portion 17 may remain positioned in the initial position i.e. the second portion 17 remains positioned substantially on the high side of the hole. In this way, the embodiment with a swivel mechanism 25 may minimize channeling on the high side of a horizontal hole by providing directed cement flow to the high side. In some embodiments, friction between the swivel mechanism 25 and the first portion 16 may result in deviation of the second portion 17 from the initial position of about ±5 degrees to about ±20 degrees (FIG. 8B).

Referring again to FIG. 3, a secondary cementing assembly 1 in accordance with the description above may be disposed downhole for operation. The hole may be a horizontal hole, a deviated hole, or a large hole. As used herein, a hole may be considered large if said hole has a diameter greater than approximately 16 in. A hole may also be considered large if the ratio between the diameter of the borehole and the outer diameter of the drill string is greater than 3. The position of the drill string 11 may be centered, off-centered, or resting along a wall of the borehole. However, if the ratio between the diameter of the borehole and the outer diameter of the drill string exceeds 3, it may be desirable to centralize the drill string. Once the secondary cementing assembly 1 has been disposed downhole, the drill string 11 may be rotated about the central axis 5. As the drill string 11 is rotated, a fluid may be sent downhole through the drill string 11 and flow out of the ports 15 of the cementing tool 14. In some other embodiments, the cementing fluid in the annulus between the cementing tool 14 and borehole may cause the second portion 17 to deviate from the initial position of about ±5 degrees to about ±20 degrees (FIG. 8B). In yet other embodiments, fluid exiting the ports may create a reaction force in the opposite direction of the fluid flow. This reaction force may cause deviation from the initial position of about 5 degrees to about 20 degrees (FIG. 8B). One of ordinary skill in the art will understand that in addition to the examples provided above, various causes of deviation from the initial position are within the scope of the present disclosure.

As discussed above, some embodiments may include a coupling 12, for example, a clutch, configured to allow the cementing tool 14 to rotate relative to the drill string 11. For example, with a spring loaded ratchet swivel clutch 24, the secondary cementing assembly may begin operation with the cementing tool 14 at an initial position as shown in FIG. 7A. The arrows in FIGS. 7A-7F indicate the direction of travel (i.e., rotation) of the cementing tool 14 and the ratchet 23. From the initial position, cementing tool 14 may rotate with the drill string, as shown in FIGS. 7A and 7B, to a preselected degree. As illustrated in FIG. 7C, this preselected degree may be about 60 degrees. However, the preselected degree may be about 90, 45, 30 degrees or any other desired angle without departing from the scope of the present disclosure. In some embodiments, the cementing tool may rotate until the outwardly facing surface 9 comes into contact with the borehole. As discussed above, by rotating with the drill string to a preselected degree, the cementing tool 14 may provide fluid coverage to the high side of the borehole through the ports located on the outwardly facing side 9 of second portion 17.

Once the cementing tool 14 has rotated with the drill string (FIG. 7C) to the preselected degree, the ratchet 23 disengages from the latch 21 and causes the cementing tool 14 to rotate backwards to the initial position (FIGS. 7D and 7E). When the cementing tool returns to the initial position (FIGS. 7A and 7F), the ratchet 23 is re-engaged, thereby rotating the cementing tool 14 with the drill string 11 again. Thus, while the drill string continues to rotate, the cementing tool 14 repeatedly rotates a preselected degree and swing backs to the initial position. For example, with a spring loaded ratchet swivel clutch 24, the cementing tool 14 rotates from the position shown in FIG. 7A to the position shown in FIG. 7C, at which time a resistance torque of the ratchet is reached, thereby releasing the ratchet. The resistance torque, or torque threshold, may be selected to correspond with a desired sweep angle, i.e., the angle of movement of the cementing tool 14. The resistance torque may be, for example, 15 to 50 ft-lbs, 30 to 50 ft-lbs, or 50 to 70 ft-lbs. However, one of ordinary skill in the art will appreciate that clutches with other thresholds may be used. Springs of the clutch bias the cementing tool 14 to the initial position, such that when the ratchet is released, the spring moves the cementing tool 14 back to the initial position (FIG. 7E).

As the cementing tool 14 pivots back to its initial position (FIG. 7F) fluid continues to exit the ports and be directed to the high side of the hole. In this way, the embodiment with a clutch may minimize channeling on the high side of a horizontal hole by providing directed cement flow to the high side. In some embodiments, the orientation of the ports may cause fluid to exit the ports such that a reaction force is created in the opposite direction. This reaction force along with the spring force of the ratchet may bias cementing tool 14 to its initial position creating relative rotation of the cementing tool 14 to the drill string 11 (FIGS. 7D and 7E). While this configuration of the cementing tool is discussed with respect to horizontal or deviated wells, one of ordinary skill in the art will appreciate that a clutched cementing tool may be used in any type of wellbore.

The clutch may reduce channeling in situations where the drill string is not centered in the hole. Further, although the actuation mechanism of the clutch has been described with respect to a spring loaded swivel clutch, one of ordinary skill in the art will appreciate that other actuation means may be used with other types of clutches without departing from the scope of the present disclosure.

Embodiments disclosed herein may provide for improved productivity. The offset portion of the tool may provide more reliable coverage of a downhole volume than current tools. Consequently, well abandonment and plugging a borehole may be faster and more cost effective. The offset of the tool allows for a greater radius of coverage to prevent channeling such that plugs may have a greater lifespan and the need for remedial cementing of cement plugs will be less frequent.

Although described above with respect to plugging a hole for abandonment, the present disclosure may also be used to provide fluid downhole; for example, to flush out a borehole. Flushing out a borehole may be necessary prior to cementing operations to remove debris from the region of the borehole to be cemented. Flushing may be accomplished by flowing fluid down the drill string and out of the ports of the secondary cementing assembly. The fluid may be drilling mud or any fluid suitable for being sent downhole known in the art.

Although only a few example embodiments have been described in detail above, those skilled in the art will readily appreciate that many modifications are possible in the example embodiments without materially departing from Cementing Tool. Accordingly, all such modifications are intended to be included within the scope of this disclosure. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wood parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed is:

1. A downhole tool comprising:

a drill string;

a tool coupled to the drill string, the tool having a distal portion;

wherein the central axis of the distal portion is offset from a central axis of the drill string;

wherein the tool comprises a port disposed on the outwardly facing surface of the distal portion of the tool;

wherein fluid flows radially outwards towards the adjacent borehole wall; and a collar disposed between a distal of the drill string and an proximal end of a tool configured to restrict rotational movement of the tool with respect to the drill string.

2. A method for plugging a hole comprising:

rotating a drill string about a central axis of the drill string;

wherein a distal end of the drill string is coupled to a tool, the tool having a distal portion;

wherein the distal portion of the tool has a central axis offset from a central axis of the drill string;

further wherein the tool comprises a port disposed on the outwardly facing surface of the distal portion of the tool;

wherein fluid flows radially outwards towards the adjacent borehole wall; and flowing a fluid down the drill string and out of the offset distal portion of the tool as the drill string is rotated.

3. The method of claim 2, further comprising swiveling the offset distal portion of the tool with respect to a straight proximal portion of the tool, the straight proximal portion coupled to the drill string.

* * * * *